US009850639B2

(12) United States Patent
Fletcher et al.

(10) Patent No.: US 9,850,639 B2
(45) Date of Patent: Dec. 26, 2017

(54) EXCAVATION SYSTEM HAVING VELOCITY BASED WORK TOOL SHAKE

(71) Applicant: Caterpillar Inc., Peoria, IL (US)

(72) Inventors: Jeffrey Graham Fletcher, Peoria, IL (US); Daniel Aaron Jones, Tasmania (AU); Ranishka De Silva Hewavisenthi, Queensland (AU); Ricky Kam Ho Chow, Queensland (AU)

(73) Assignee: Caterpillar Inc., Peoria, IL (US)

( * ) Notice: Subject to any disclaimer, the term of this patent is extended or adjusted under 35 U.S.C. 154(b) by 108 days.

(21) Appl. No.: 14/790,423

(22) Filed: Jul. 2, 2015

(65) Prior Publication Data

US 2017/0002542 A1 Jan. 5, 2017

(51) Int. Cl.

| | |
|---|---|
| ***E02F 3/84*** | (2006.01) |
| ***E02F 3/43*** | (2006.01) |
| ***E02F 3/40*** | (2006.01) |
| ***E02F 9/26*** | (2006.01) |

(52) U.S. Cl.

CPC ..... *E02F 3/844* (2013.01); *E02F 3/434* (2013.01); *E02F 9/265* (2013.01); *E02F 3/405* (2013.01)

(58) Field of Classification Search

CPC ..... E02F 3/28; E02F 3/844; E02F 9/26

See application file for complete search history.

(56) References Cited

U.S. PATENT DOCUMENTS

| | | | |
|---|---|---|---|
| 5,065,326 | A | 11/1991 | Sahm |
| 5,293,944 | A | 3/1994 | Matsumoto |
| 5,535,532 | A | 7/1996 | Fujii et al. |
| 5,617,724 | A | 4/1997 | Ko |
| 5,960,378 | A | 9/1999 | Watanabe et al. |
| 5,968,103 | A | 10/1999 | Rocke |

(Continued)

FOREIGN PATENT DOCUMENTS

| | | |
|---|---|---|
| CN | 103292715 | 9/2013 |
| WO | WO 2010/074003 A1 | 7/2010 |

OTHER PUBLICATIONS

U.S. Patent Application entitled "Excavation System Providing Impact Detection" filed Jul. 7, 2015 by Jeffrey Graham Fletcher et al.

(Continued)

*Primary Examiner* — Khoi H Tran
*Assistant Examiner* — Kelly D Williams
(74) *Attorney, Agent, or Firm* — Finnegan, Henderson, Farabow, Garrett & Dunner, LLP

(57) ABSTRACT

An excavation system is disclosed for a machine having a work tool. The excavation system may have at least one sensor to generate a signal indicative of a load exerted on the work tool. The excavation system may also have a lift actuator and a tilt actuator. The excavation system may also have a controller configured to detect engagement of the work tool with a material pile based the signal. The controller may operate the work tool to load the work tool with an amount of material. The controller may determine whether loading of the work tool has been completed. The controller may lift the work tool when the loading has been completed. The controller may also operate the tilt actuator to shake the work tool. Additionally, the controller may cause the machine to withdraw from the material pile after shaking the work tool.

20 Claims, 5 Drawing Sheets

(56) References Cited

U.S. PATENT DOCUMENTS

| | | | | |
|---|---|---|---|---|
| 5,974,352 | A | 10/1999 | Shull | |
| 6,205,687 | B1 | 3/2001 | Rocke | |
| 6,321,153 | B1 | 11/2001 | Rocke et al. | |
| 6,363,632 | B1 | 4/2002 | Stentz et al. | |
| 6,615,114 | B1 | 9/2003 | Skiba et al. | |
| 6,879,899 | B2 | 4/2005 | Budde | |
| 7,555,855 | B2 | 7/2009 | Alshaer et al. | |
| 7,640,683 | B2 | 1/2010 | McCain | |
| 7,658,234 | B2 | 2/2010 | Brandt et al. | |
| 7,797,934 | B2 | 9/2010 | Bacon et al. | |
| 7,853,382 | B2 | 12/2010 | Anderson | |
| 7,865,285 | B2 | 1/2011 | Price et al. | |
| 8,042,290 | B2 | 10/2011 | Hartwick | |
| 8,145,394 | B2 | 3/2012 | Chiorean et al. | |
| 8,160,783 | B2 | 4/2012 | Shull | |
| 8,280,596 | B2 | 10/2012 | Hagenbuch | |
| 8,363,210 | B2 | 1/2013 | Montgomery | |
| 8,478,492 | B2 | 7/2013 | Taylor et al. | |
| 8,527,155 | B2 | 9/2013 | Gudat | |
| 8,654,608 | B2 | 2/2014 | Lindskov | |
| 8,726,647 | B2 | 5/2014 | Peterson et al. | |
| 8,813,486 | B2 | 8/2014 | Peterson et al. | |
| 8,838,329 | B2 | 9/2014 | Seki | |
| 8,874,265 | B2 | 10/2014 | Rakshit | |
| 8,886,493 | B2 | 11/2014 | Taylor | |
| 8,903,689 | B2 | 12/2014 | Dunbabin et al. | |
| 2003/0209134 | A1* | 11/2003 | Tabor | E02F 3/405 91/275 |
| 2009/0326768 | A1* | 12/2009 | Shull | E02F 3/431 701/50 |
| 2012/0055051 | A1 | 3/2012 | Polston et al. | |
| 2013/0158789 | A1 | 6/2013 | Seki | |
| 2014/0277957 | A1 | 9/2014 | Clar et al. | |

OTHER PUBLICATIONS

U.S. Patent Application entitled "Excavation System Providing Automated Tool Linkage Calibration" filed Jul. 7, 2015 by Jeffrey Graham Fletcher et al.

U.S. Patent Application entitled "Excavation System Providing Automated Stall Correction" filed Jul. 7, 2015 by Jeffrey Graham Fletcher et al.

U.S. Application entitled "Excavation System Having Adaptive Dig Control" filed Jul. 7, 2015 by Jeffrey Graham Fletcher et al.

* cited by examiner

EXCAVATION SYSTEM HAVING VELOCITY BASED WORK TOOL SHAKE

TECHNICAL FIELD

The present disclosure relates generally to an excavation system and, more particularly, to an excavation system having velocity based work tool shake.

BACKGROUND

Excavation, mining, or other earth removal activities often employ machines, such as load-haul-dump machines (LHDs), wheel loaders, carry dozers, etc. to remove (i.e. scoop up) material from a pile at a first location (e.g., within a mine tunnel), to haul the material to a second location (e.g., to a crusher), and to dump the material at the second location. Productivity of the material removal process depends on the efficiency of a machine during each excavation cycle. For example, the efficiency increases when the machine can sufficiently load a machine tool (e.g., a bucket) with material at the pile within a short amount of time, haul the material via a direct path to the second location, and dump the material at the second location as quickly as possible.

As the machine travels from the first location to the second location, some of the material in the tool may spill from the tool and fall on the machine or along the path travelled by the machine. In some applications, for example, underground mining operations, spillage can create hazardous conditions by creating obstructions in the path of the machine. Because the amount of space available in underground operations is relatively small, cleanup of the spilled material is difficult and may also cause reduction in productivity of the machines.

U.S. Pat. No. 8,160,783 of Shull that issued on Apr. 17, 2012 ("the '783 patent") discloses a digging control system for loading a work implement of a machine with material from a pile. In particular, the '783 patent discloses a controller configured to initiate tilting of the work implement when the controller determines that the loading of the work implement exceeds a threshold loading. The '783 patent also discloses that the controller monitors a tilt angle of the work implement and ceases tilting of the work implement when the tilt angle of the work implement equals a threshold tilt angle. By controlling tilting of the work implement in this manner, the controller of the '783 patent aims to reduce the average loading of the work implement during lifting and tilting of the work implement, reducing the energy expended by the machine. Further, the controller of the '783 patent aims to prevent needless pushing of the material forward into the pile.

Although the digging control system disclosed in the '783 patent discloses controlling tilting of the work implement to reduce the energy consumption of the machine, the disclosed system may not prevent spillage of material from the work implement. In particular, although the control system of the '783 patent may help ensure that the material is loaded into the work implement instead of being pushed forward into the pile by the work implement, material may still fall out of the work implement as the machine moves from the loading location to a dumping location.

The excavation system of the present disclosure solves one or more of the problems set forth above and/or other problems of the prior art.

SUMMARY

In one aspect, the present disclosure is directed to an excavation system for a machine having a work tool. The excavation system may include at least one sensor configured to generate a signal indicative of a load exerted on the work tool. The excavation system may also include a lift actuator configured to lift the work tool above a ground surface. The excavation system may further include a tilt actuator configured to tilt the work tool. The excavation system may include a controller in communication with the sensor, the lift actuator, and the tilt actuator. The controller may be configured to detect engagement of the work tool with a material pile based on the signal. The controller may also be configured to operate the work tool to load the work tool with an amount of material. Further, the controller may be configured to determine whether loading of the work tool has been completed. The controller may be configured to operate the lift actuator to lift the work tool when the loading has been completed. The controller may also be configured to operate the tilt actuator to shake the work tool. In addition, the controller may be configured to cause the machine to withdraw from the material pile after shaking the work tool.

In another aspect, the present disclosure is directed to a method of controlling a machine having a work tool. The method may include sensing a parameter indicative of a load exerted on the work tool. The method may also include detecting engagement of the work tool with a material pile based on the parameter. Further, the method may include operating the work tool to load the work tool with an amount of material. The method may also include determining whether loading of the work tool has been completed. The method may include lifting the work tool above a ground surface, using a lift actuator of the machine, when the loading has been completed. The method may also include shaking the work tool using a tilt actuator of the machine. In addition, the method may include causing the machine to withdraw from the material pile after shaking the work tool.

In yet another aspect, the present disclosure is direct to a machine. The machine may include a frame. The machine may also include a plurality of wheels rotatably connected to the frame and configured to support the frame. The machine may further include a power source mounted to the frame and configured to drive the plurality of wheels. The machine may also include a work tool operatively connected to the frame, driven by the power source, and having a tip configured to engage a material pile. The machine may include a lift actuator configured to lift the work tool above a ground surface. The machine may also include a tilt actuator configured to tilt the work tool. Further, the machine may include a speed sensor associated with the plurality of wheels and configured to generate a first signal indicative of a travel speed of the machine. The machine may also include a torque sensor associated with the powertrain and configured to generate a second signal indicative of a torque output of the powertrain. In addition, the machine may include an acceleration sensor configured to generate a third signal indicative of an acceleration of the mobile machine. The machine may also include a controller in communication with the speed sensor, the torque sensor, and the acceleration sensor. The controller may be configured to detect engagement of the work tool with the material pile based on at least one of the first, second, and third signals. The controller may also be configured to operate the work tool to load the work tool with an amount of material. Further, the controller may be configured to determine whether loading of the work tool has been completed. The controller may also be configured to lift the work tool, using the lift actuator, when the loading has been completed. The controller may be configured to perform a first rack of the work tool. The controller may also be configured to monitor a tilt cylinder velocity. Further, the controller may be configured to perform a first unrack of the work tool, when the tilt cylinder velocity is less than a threshold velocity. The controller may also be configured to monitor a tip angle of the work tool while performing the first unrack of the work tool. In addition, the controller may be configured to perform a second rack of the work tool when the tip angle is about equal to a target tip angle.

DETAILED DESCRIPTION

Figure 1:
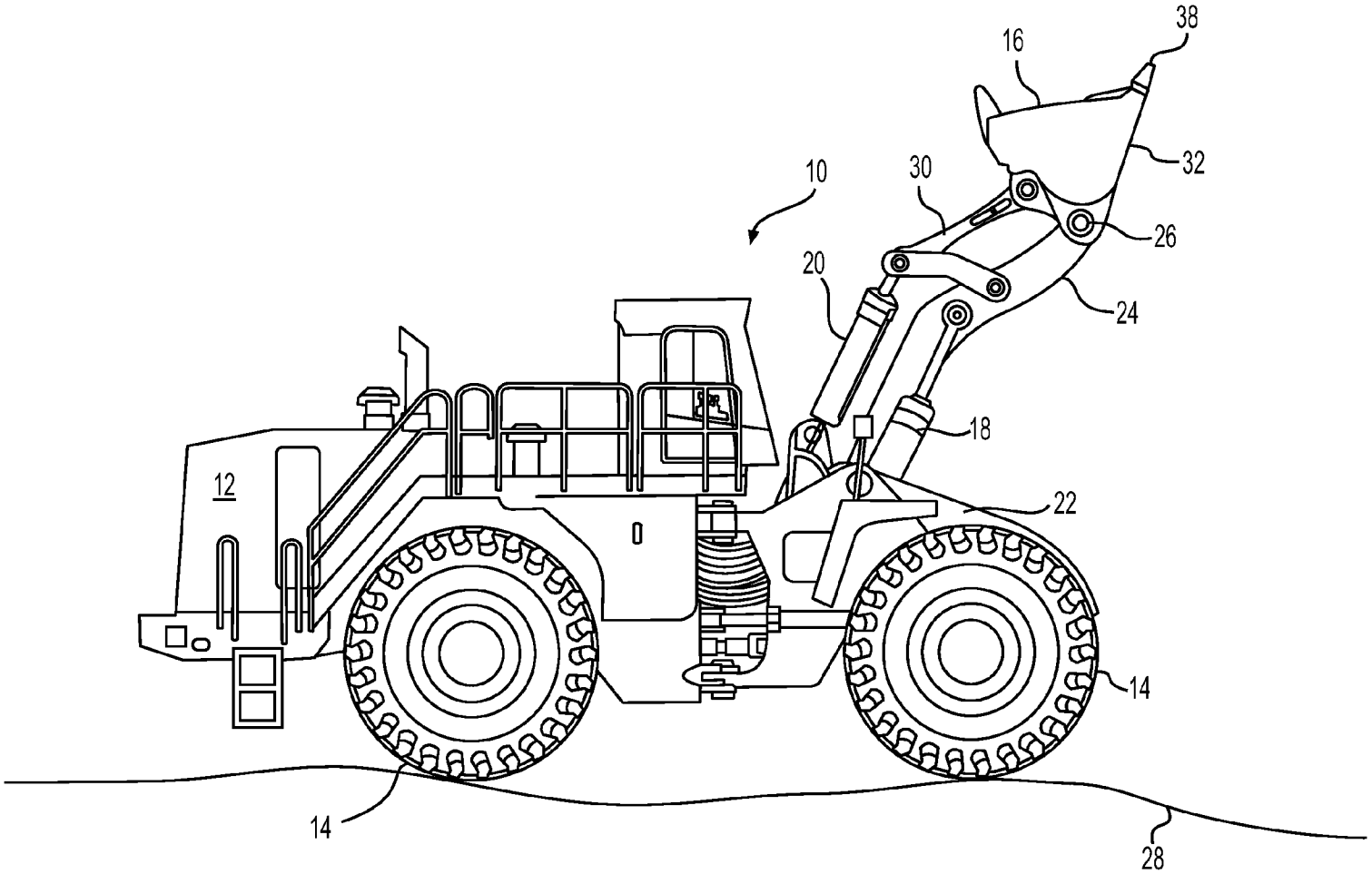
FIG. 1 is a side-view illustration of an exemplary disclosed machine.

FIG. 1 illustrates an exemplary embodiment of a machine 10. In the disclosed example, machine 10 is a load-haul-dump machine (LHD). It is contemplated, however, that machine 10 could embody another type of excavation machine (e.g., a wheel loader or a carry dozer). Machine 10 may include, among other things, a power source 12, one or more traction devices 14 (e.g. wheels), a work tool 16, one or more lift actuators 18, and one or more tilt actuators 20. Lift actuators 18 and tilt actuators 20 may connect work tool 16 to frame 22 of machine 10. In one exemplary embodiment as illustrated in FIG. 1, lift actuators 18 may have one end connected to frame 22 and an opposite end connected to a structural member 24, which may be connected to work tool 16. Work tool 16 may be connected to structural member 24 via pivot pin 26. Lift actuators 18 may be configured to lift or raise work tool 16 to a desired height above ground surface 28. In one exemplary embodiment as illustrated in FIG. 1, tilt actuators 20 may have one end connected to frame 22 and an opposite end connected to linkage member 30, which may be connected to work tool 16. Tilt actuators 20 may be configured to alter an inclination of a lower surface 32 of work tool 16 relative to ground surface 28.

Power source 12 may be supported by a frame 22 of machine 10, and may include an engine (not shown) configured to produce a rotational power output and a transmission (not shown) that converts the power output to a desired ratio of speed and torque. The rotational power output may be used to drive a pump (not shown) that supplies pressurized fluid to lift actuators 18, tilt actuators 20, and/or to one or more motors (not shown) associated with wheels 14. The engine of power source 12 may be a combustion engine configured to burn a mixture of fuel and air, the amount and/or composition of which directly corresponding to the rotational power output. The transmission of power source 12 may take any form known in the art, for example a power shift configuration that provides multiple discrete operating ranges, a continuously variable configuration, or a hybrid configuration. Power source 12, in addition to driving work tool 16, may also function to propel machine 10, for example via one or more traction devices (e.g., wheels) 14.

Numerous different work tools 16 may be operatively attachable to a single machine 10 and driven by power source 12. Work tool 16 may include any device used to perform a particular task such as, for example, a bucket, a fork arrangement, a blade, a shovel, or any other task-performing device known in the art. Although connected in the embodiment of FIG. 1 to lift and tilt relative to machine 10, work tool 16 may alternatively or additionally rotate, slide, swing open/close, or move in any other manner known in the art. Lift and tilt actuators 18, 20 may be extended or retracted to repetitively move work tool 16 during an excavation cycle.

Figure 2:
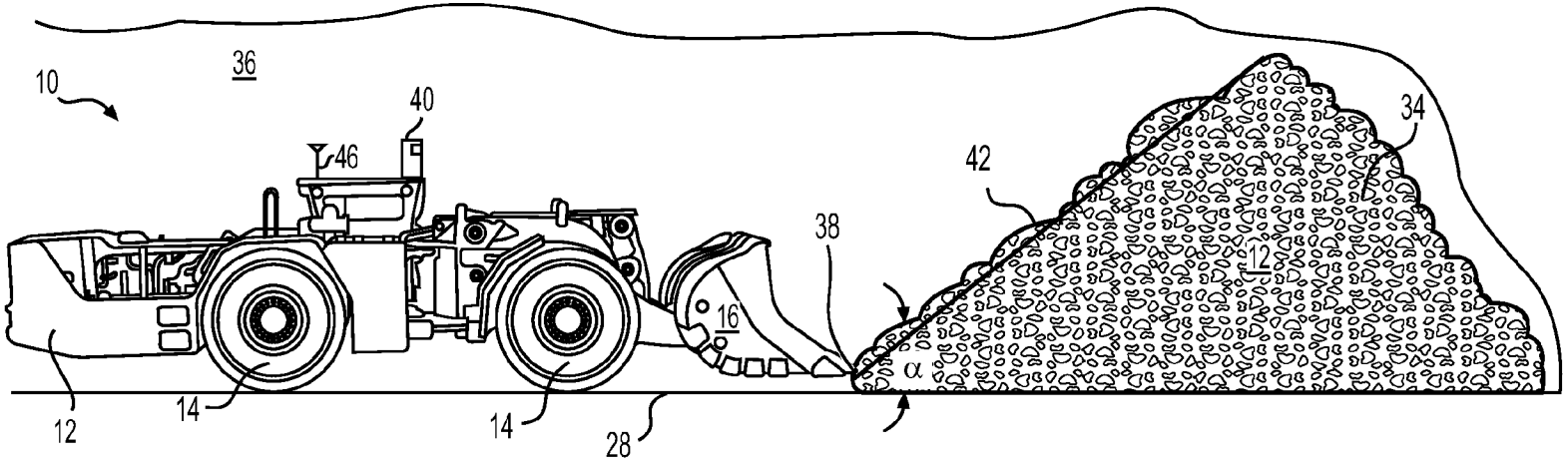
FIG. 2 is a side-view illustration of the machine of FIG. 1 operating at an exemplary disclosed worksite.

In one exemplary embodiment as illustrated in FIG. 2, the excavation cycle may be associated with removing a material pile 34 from inside of a mine tunnel 36. Material pile 34 may constitute a variety of different types of materials. For example, material pile 34 may consist of loose sand, dirt, gravel etc. In other exemplary embodiments, material pile 34 may consist of mining materials, or other tough material such as clay, rocks, mineral formations, etc. In one exemplary embodiment as illustrated in FIG. 2, work tool 16 may be a bucket having a tip 38 configured to penetrate the material pile 34. Machine 10 may also include one or more externally mounted sensors 40 configured to determine a distance of the sensor from pile face 42. Each sensor 40 may be a device, for example a LIDAR (light detection and ranging) device, a RADAR (radio detection and ranging) device, a SONAR (sound navigation and ranging) device, a camera device, or another device known in the art for determining a distance. Sensor 40 may generate a signal corresponding to the distance, direction, size, and/or shape of the object at the height of sensor 40, and communicate the signal to an on-board controller 44 (shown only in FIG. 3) for subsequent conditioning.

Alternatively or additionally, machine 10 may be outfitted with a communication device 46 that allows communication of the sensed information to an off-board entity. For example, excavation machine 10 may communicate with a remote control operator and/or a central facility (not shown) via communication device 46. This communication may include, among other things, the location of material pile 34, properties (e.g., shape) of material pile 34, operational parameters of machine 10, and/or control instructions or feedback.

Figure 3:
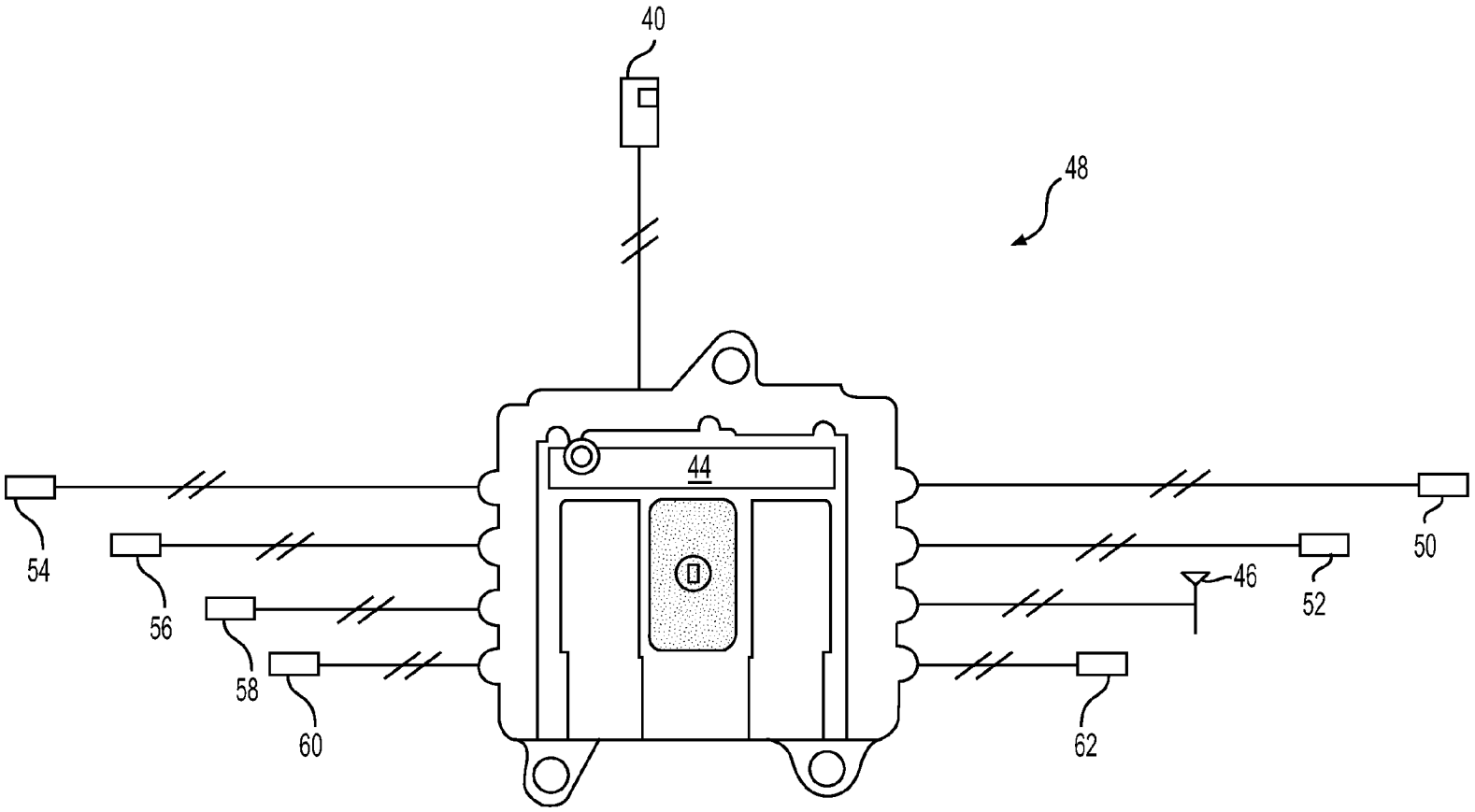
FIG. 3 is a diagrammatic illustration of an exemplary disclosed excavation system that may be used in conjunction with the machine of FIG. 1.

FIG. 3 illustrates an excavation system 48 configured to automatically determine various operational parameters of machine 10 to improve efficiency of machine 10 in an excavation cycle. Excavation system 48 may include, among other things, sensor 40, controller 44, communication device 46, speed sensor 50, at least one load sensor 52, lift sensor 56, tilt sensor 58, lift pressure sensor 60, and tilt pressure sensor 62. Controller 44 may be in communication with each of these sensors and numerous other components of excavation system 48 and, as will be explained in more detail below, configured to detect engagement of work tool 16 (referring to FIG. 2) with material pile 34, to determine a repose angle $\alpha$ of material pile 34, to determine a tip angle $\beta$ of tip 38, to determine one or more tilt control parameters for work tool 16, etc. This information may be used for remotely or autonomously controlling machine 10, including, among other things, to control operation of work tool 16.

Controller 44 may embody a single microprocessor or multiple microprocessors that include a means for monitoring operations of excavation machine 10, communicating with an off-board entity, and detecting properties of material pile 34. For example, controller 44 may include a memory, a secondary storage device, a clock, and a processor, such as a central processing unit or any other means for accomplishing a task consistent with the present disclosure. The memory or secondary storage device associated with controller 44 may store data and/or routines that may assist controller 44 to perform its functions. Further the memory or storage device associated with controller 44 may also store data received from the various sensors associated with machine 10. Numerous commercially available microprocessors can be configured to perform the functions of controller 44. It should be appreciated that controller 44 could readily embody a general machine controller capable of controlling numerous other machine functions. Various other known circuits may be associated with controller 44, including signal-conditioning circuitry, communication circuitry, hydraulic or other actuation circuitry, and other appropriate circuitry.

Communication device 46 may include hardware and/or software that enable the sending and/or receiving of data messages through a communications link. The communications link may include satellite, cellular, infrared, radio, and/or any other type of wireless communications. Alternatively, the communications link may include electrical, optical, or any other type of wired communications. In one embodiment, on-board controller 44 may be omitted, and an off-board controller (not shown) may communicate directly with sensor 40, speed sensor 50, one or more load sensors 52, lift sensor 56, tilt sensor 58, lift pressure sensor 60, tilt pressure sensor 62, and/or other components of machine 10 via communication device 46.

Speed sensor 50 may embody a conventional rotational speed detector having a stationary element rigidly connected to frame 22 (referring to FIG. 1) that is configured to sense a relative rotational movement of wheel 14 (e.g., of a rotating portion of power source 12 that is operatively connected to wheel 14, such as an axle, a gear, a cam, a hub, a final drive, etc.). The stationary element may be a magnetic or optical element mounted to an axle housing (e.g., to an internal surface of the housing) and configured to detect the rotation of an indexing element (e.g., a toothed tone wheel, an embedded magnet, a calibration stripe, teeth of a timing gear, a cam lobe, etc.) connected to rotate with one or more of wheels 14. The indexing element may be connected to, embedded within, or otherwise form a portion of the front axle assembly that is driven to rotate by power source 12. Speed sensor 50 may be located adjacent the indexing element and configured to generate a signal each time the indexing element (or a portion thereof, for example a tooth) passes near the stationary element. This signal may be directed to controller 44, which may use this signal to determine a distance travelled by machine 10 between signal generation times (i.e., to determine a travel speed of machine 10). Controller 44 may record the traveled distances and/or speed values associated with the signal in a memory or other secondary storage device associated with controller 44. Alternatively or additionally, controller 44 may record a number of wheel rotations, occurring within fixed time intervals, and use this information along with known kinematics of wheel 14 to determine the distance and speed values. Other types of sensors and/or strategies may also or alternatively be employed to determine a travel speed of machine 10.

Load sensor 52 may be any type of sensor known in the art that is capable of generating a load signal indicative of an amount of load exerted on work tool 16, for example by material pile 34 when work tool 16 comes into contact with material pile 34. Load sensor 52 may, for example, be a torque sensor associated with power source 12, or an accelerometer. When load sensor 52 is embodied as a torque sensor, the load signal may correspond with a change in torque output experienced by power source 12 during travel of machine 10. In one exemplary embodiment, the torque sensor may be physically associated with the transmission or final drive of power source 12. In another exemplary embodiment, the torque sensor may be physically associated with the engine of power source 12. In yet another exemplary embodiment, the torque sensor may be a virtual sensor used to calculate the torque output of power source 12 based on one or more other sensed parameters (e.g., fueling of the engine, speed of the engine, and/or the drive ratio of the transmission or final drive). When load sensor 52 is embodied as an accelerometer, the accelerometer may embody a conventional acceleration detector rigidly connected to frame 22 or other components of machine 10 in an orientation that allows sensing of changes in acceleration in the forward and rearward directions for machine 10. It is contemplated that excavation system 48 may include any number and types of load sensors 52.

Lift sensor 56 may embody a magnetic pickup-type sensor associated with a magnet (not shown) embedded within lift actuators 18. In this configuration, lift sensor 56 may be configured to detect an extension position or a length of extension of lift actuator 18 by monitoring the relative location of the magnet, and generate corresponding position and/or lift velocity signals directed to controller 44 for further processing. It is also contemplated that lift sensor 56 may alternatively embody other types of sensors such as, for example, magnetostrictive-type sensors associated with a wave guide (not shown) internal to lift actuator 18, cable type sensors associated with cables (not shown) externally mounted to lift actuator 18, internally- or externally-mounted optical sensors, LIDAR, RADAR, SONAR, or camera type sensors or any other type of height-detection sensors known in the art. From the position and/or velocity signals generated by lift sensor 56 and based on known geometry and/or kinematics of frame 22, lift actuators 18 and tilt actuators 20, and other connecting components of machine 10, controller 44 may be configured to calculate a height of work tool 16 above ground surface 28. In one exemplary embodiment, controller 44 may be configured to calculate a height of lower surface 32 of work tool 16 above ground surface 28. In another exemplary embodiment, controller 44 may be configured to calculate a height of tip 38 of work tool 16 above ground surface 28. In yet another exemplary embodiment, controller 44 may be configured to calculate a height of pivot pin 26 (shown in FIGS. 1 and 2) of work tool 16 above ground surface 28.

Tilt sensor 58 may also embody a magnetic pickup-type sensor associated with a magnet (not shown) embedded within tilt actuator 20. In this configuration, tilt sensor 58 may be configured to detect an extension position or a length of extension of tilt actuator 20 by monitoring the relative location of the magnet, and generate corresponding position and/or tilt velocity signals directed to controller 44 for further processing. From the position and/or tilt velocity signals generated by tilt sensor 58 and based on known geometry and/or kinematics of frame 22, lift actuators 18 and tilt actuators 20, and other connecting components of machine 10, controller 44 may be configured to calculate tip angle "β," representing an angle of inclination of lower surface 32 of work tool 16 relative to ground surface 28. It is also contemplated that controller 44 may be able to use signals generated by one or more tilt sensors 58 to determine a rack angle "$\beta_{rack}$" and/or an unrack angle "$\beta_{unrack}$" of work tool 16. As used in this disclosure, $\beta_{rack}$ refers to a change in the angular position of work tool 16 from its current position as work tool 16 is tilted away from ground surface 28. Likewise, as used in this disclosure, $\beta_{unrack}$ refers to a change in the angular position of work tool 16 from its current position as work tool 16 is tilted towards ground surface 28. It is also contemplated that tilt sensor 58 may alternatively embody other types of sensors such as, for example, magnetostrictive-type sensors associated with a wave guide (not shown) internal to tilt actuator 20, cable type sensors associated with cables (not shown) externally mounted to tilt actuator 20, internally- or externally-mounted optical sensors, rotary style sensors associated with joints pivotable by tilt actuators 20, or any other type of angle-detection sensors known in the art.

One or more lift pressure sensors 60 may be strategically located within the one or more lift actuators 18 to sense a pressure of the fluid within lift actuators 18. Lift pressure sensor 60 may generate a corresponding signal indicative of the pressure within lift actuator 18 and direct the signal to controller 44. Likewise, one or more tilt pressure sensors 62 may be strategically located within the one or more tilt actuators 20 to sense a pressure of the fluid within tilt actuators 20. Tilt pressure sensor 62 may generate a corresponding signal indicative of the pressure within tilt actuator 20 and direct the signal to controller 44. Controller 44 may use the information received from the one or more sensors and components of machine 10 to control operations of machine 10, as will be described in more detail below.

Figure 4:
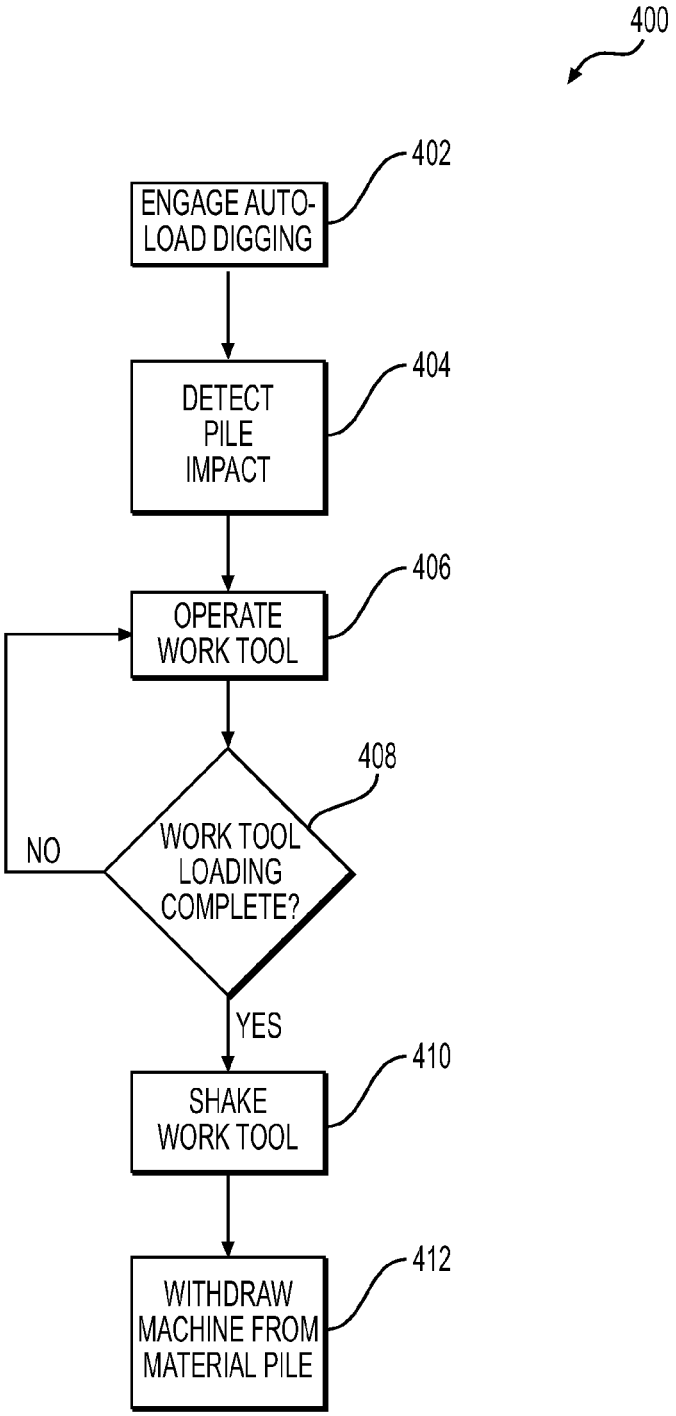
FIG. 4 is a flowchart illustrating an exemplary disclosed method of excavation performed by the excavation system of FIG. 3.
Figure 5:
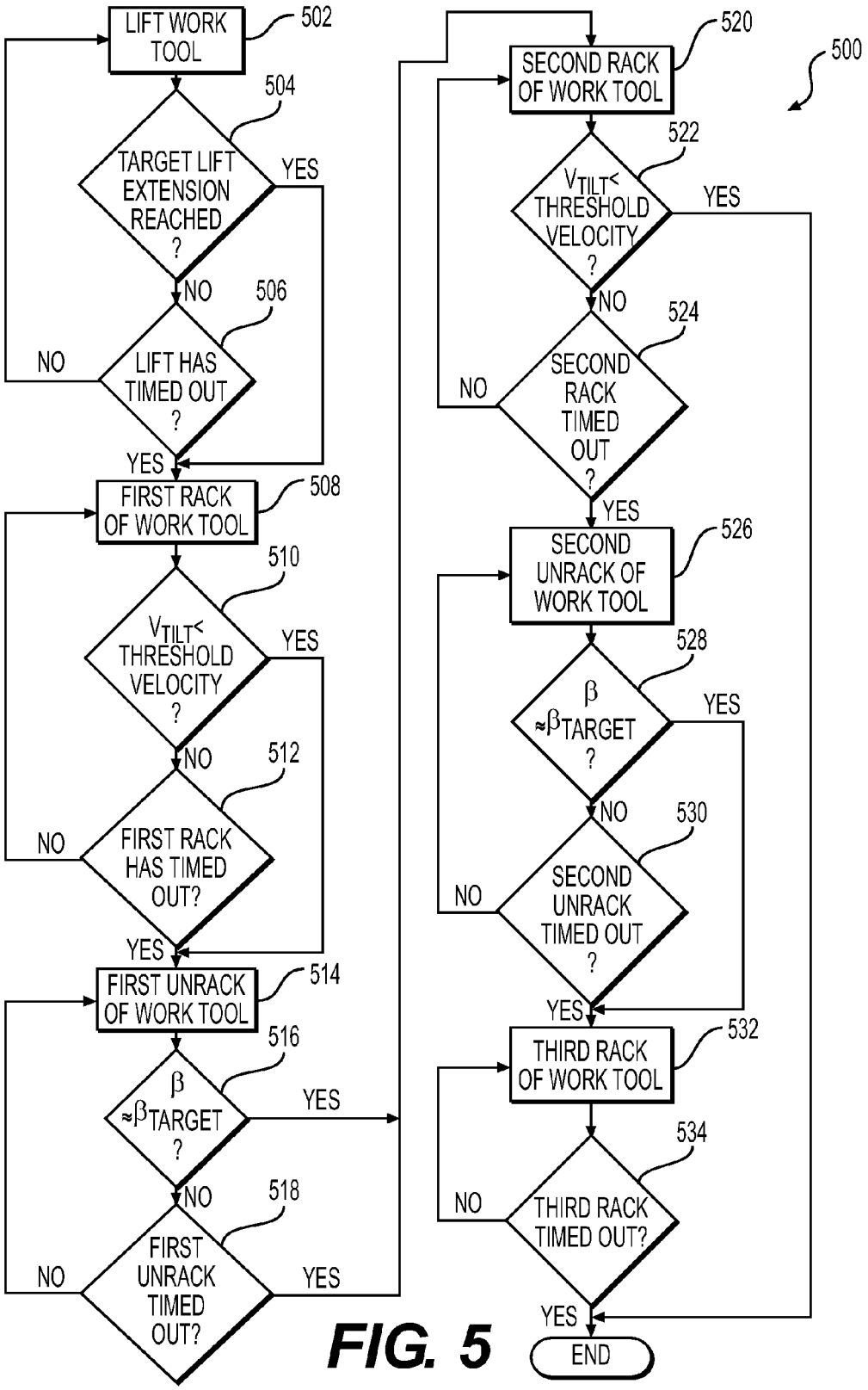
FIG. 5 is a flowchart illustrating an exemplary disclosed method of work tool shake performed by the excavation system of FIG. 3.

FIGS. 4 and 5 illustrate exemplary methods that may be performed by excavation system 48. FIGS. 4 and 5 will be discussed in more detail in the following section to further illustrate the disclosed concepts.

INDUSTRIAL APPLICABILITY

The disclosed excavation system may be used in any machine at a worksite where it is desirable to remotely or autonomously control the machine while ensuring that a work tool of the machine is sufficiently loaded with material. For example, the disclosed excavation system may be used in a LHD, wheel loader, or carry dozer that operates under hazardous conditions. The excavation system may assist control of the machine by automatically loading the work tool with material from a material pile and shaking the work tool to ensure loose material falls out of the work tool on the material pile before the machine withdraws from the material pile to travel to a dump location. Operation of excavation system 48 will now be described in detail with reference to FIGS. 4 and 5.

FIG. 4 illustrates an exemplary disclosed method of excavation 400 performed by excavation system 48. Method 400 may include a step of engaging auto-load digging (Step 402) for machine 10 at any time during forward travel of machine 10. The auto-load digging functionality may help ensure that sufficient amount of material is loaded in work tool 16 during each excavation cycle. In step 402, controller 44 may initiate the auto-load digging functionality in response to a variety of inputs. For example, controller 44 may automatically initiate auto-load digging in response to a detection of forward travel (e.g., in response to a signal from speed sensor 50). In another example, controller 44 may initiate auto-load digging in response to a proximity to material pile 34 (e.g., in response to a signal from sensor 40). In yet another example, auto-loading may be initiated manually by a local or remote operator. Any combination of these inputs (and others) may be utilized to initiate auto-load digging functionality.

Method 400 may include a step of detecting pile impact, for example, detecting contact of work tool 16 with material pile 34 (Step 404). In one exemplary embodiment, controller 44 may orient work tool 16 so that lower surface 32 of work tool 16 is disposed generally parallel to ground surface 28. As machine 10 travels towards material pile 34 with work tool 16 disposed generally parallel to ground surface 28, controller may receive signals from various components of machine 10. Controller 44 may detect contact of work tool 16 with material pile 34 based on a sharp change in acceleration of machine 10. Alternatively or additionally, controller 44 may detect a slowing down of machine 10 by detecting a sharp change in torque output of power source 12 (i.e., by an increase in torque output). Accordingly, controller 44 may continuously compare monitored values of torque output and acceleration to respective threshold values to detect engagement of work tool 16 with material pile 34.

Method 400 may include a step of operating the work tool (Step 406). To operate the work tool in step 406, controller 44 may issue commands to one or more lift actuators 18 and tilt actuators 20 to lift work tool 16 and rack and unrack work tool 16 as work tool 16 penetrates material pile 34. By actuating the lift actuators 18 and tilt actuators 20 in this manner, controller 44 may help ensure that material from material pile 34 may be removed and loaded into work tool 16.

Method 400 may include a step of determining whether loading of work tool 16 with material is complete (step 408). Controller 44 may determine whether loading of work tool 16 is complete based on one or more of a plurality of conditions. For example, controller 44 may determine that loading of work tool 16 is complete when a height of pivot pin 26 above ground surface 28 exceeds a target height. Alternatively, controller 44 may determine that loading of work tool 16 is complete when an amount of material in work tool 16 exceeds a target amount. Controller 44 may also determine that loading of work tool 16 is complete when tip 38 has penetrated material pile 34 by a distance that exceeds a target penetration distance. In another exemplary embodiment, controller 44 may determine that loading of work tool 16 is complete when a tip angle β of tip 38 exceeds a tip angle target. Controller 44 may determine that loading of work tool 16 is complete when controller 44 detects that tip 38 of work tool 16 has been extracted from material pile 34. When controller 44 determines that loading of work tool 16 is not complete (Step 408: No) based on any of the above conditions, controller 44 may return to step 406 to continue operating work tool 16 to load work tool 16 with material. Thus, controller 44 may cycle through steps 406 and 408 to continuously monitor whether loading of work tool 16 is complete as work tool 16 is loaded with material. When controller 44 determines, however, that loading of work tool 16 is complete (Step 408: Yes), controller may proceed to step 410.

In step 410, controller 44 may shake work tool 16 to cause any loose material in work tool 16 to spill out on material pile 34. Controller 44 may shake work tool 16 by racking and unracking work tool 16 multiple times in quick succession. In one exemplary embodiment, controller 44 may rack and unrack work tool 16 at least 2 times in step 410. Further details regarding the process of shaking work tool 16 will be discussed below with respect to FIG. 5.

Method 400 may include a step of causing machine 10 to withdraw from material pile 34 after shaking work tool 16 (Step 412). After withdrawing from material pile 34, machine 10 may proceed along a designated path to a dump location to dump the contents of work tool 16 at the dump location. By shaking work tool 16 before withdrawing machine 10 from material pile 34, method 400 may help ensure that loose material from work tool 16 may be spilled on material pile 34 for pickup by machine 10 during a subsequent excavation cycle. Further, by helping ensure that loose material from work tool 16 is spilled on material pile 34, method 400 may help ensure that loose material does not spill along the path from material pile 34 to the dump location. This in turn may help to keep the path clear of debris and reduce and/or eliminate the need to clean the path of any spillage from work tool 16 as machine 10 travels over the path.

FIG. 5 illustrates an exemplary disclosed method 500 of shaking work tool 16 performed by excavation system 48. Method 500 may include a step of lifting work tool 16 above ground surface 28 (Step 502). In step 502, controller 44 may issue commands to cause lift actuators 18 to lift or raise work tool 16 above ground surface 28. In one exemplary embodiment, controller 44 may do so by issuing commands to operate pumps or other components to pump hydraulic fluid into lift actuators 18 causing lift actuators 18 to extend and raise work tool 16 above ground surface 28.

Method 500 may include a step of determining whether a target extension (i.e. target length) has been reached by lift actuator 18 (Step 504). When controller 44 determines that lift actuator 18 has reached a target extension (Step 504: Yes), controller 44 may proceed to step 508. When controller 44 determines, however, that lift actuator 18 has not reached the target extension (Step 504: No), controller 44 may proceed to step 506 of determining whether lifting has timed out. In one exemplary embodiment, the target length ranges from about 15% to 20% of a maximum length of extension of lift actuator 18.

Controller 44 may initialize a timer (i.e. set the timer to 0) when executing step 502 to lift work tool 16. Controller 44 may monitor an elapsed time as lift actuators 18 lift work tool 16 above ground surface 28. Controller may periodically compare the elapsed time with a target lift time, which may represent a maximum amount of time for lifting work tool 16 to the target height. Controller 44 may determine that lifting has timed out (Step 506), when the elapsed time exceeds the target lift time and lift actuator 18 has not reached the target extension. When controller 44 determines that lifting has timed out (Step 506: Yes), controller 44 may proceed to step 508. When controller 44 determines, however, that lifting has not timed out (Step 506: No), controller 44 may return to step 502 to continue lifting work tool 16. Controller 44 may cycle through one or more of steps 502-506 to lift work tool 16 and help ensure that work tool 16 is free from material pile 34 before shaking work tool 16 to remove loose material from work tool 16.

Method 500 may include a step of performing a first rack of work tool 16 (Step 508). In step 508, controller 44 may issue commands to cause tilt actuators 20 to rack (i.e. tilt) work tool 16 away from ground surface 28. In one exemplary embodiment, controller 44 may do so by issuing commands to operate pumps or other components to pump hydraulic fluid into tilt actuators 20 causing lift actuators 18 to extend and tilt work tool 16 away from ground surface 28.

Method 500 may include a step of determining whether a tilt velocity $V_{tilt}$ is less than a threshold tilt velocity of work tool 16. Controller 44 may use signals from, among other things, tilt sensor 58 to determine a tilt velocity of work tool 16 at periodic intervals as work tool 16 tilts away from ground surface 28. When controller 44 determines that tilt velocity $V_{tilt}$ of work tool 16 is less than a threshold velocity (Step 510: Yes), controller 44 may proceed to step 514. When controller 44 determines, however, that tilt velocity $V_{tilt}$ of work tool 16 is greater than the threshold velocity (Step 510: No), controller 44 may proceed to step 512 of determining whether first rack has timed out.

Controller 44 may initialize a timer (i.e. set the timer to 0) when executing step 508 of racking work tool 16. Controller 44 may monitor an elapsed time as tilt actuators 20 tilt work tool 16 away from ground surface 28. Controller may periodically compare the elapsed time with a target rack time, which may represent a maximum amount of time permitted for racking work tool 16. Controller 44 may determine that first rack has timed out (Step 512), when the elapsed time exceeds the target first rack time and tilt velocity $V_{tilt}$ of work tool 16 remains higher than the threshold velocity. When controller 44 determines that first rack has timed out (Step 512: Yes), controller 44 may proceed to step 514. When controller 44 determines, however, that first rack has not timed out (Step 512: No), controller 44 may return to step 508 to continue racking work tool 16. Controller 44 may cycle through one or more of steps 508-510 to rack work tool 16.

Method 500 may include a step of performing a first unrack of work tool 16 (Step 514). In step 514, controller 44 may issue commands to cause tilt actuators 20 to unrack (i.e. tilt) work tool 16 towards ground surface 28. In one exemplary embodiment, controller 44 may do so by issuing commands to operate pumps or other components to pump hydraulic fluid out of tilt actuators 20 causing tilt actuators 20 to contract and tilt work tool 16 towards ground surface 28.

Method 500 may include a step of determining whether a tip angle $\beta$ exceeds $\beta_{target}$, a target tip angle (Step 516). Controller 44 may use signals from, among other things, tilt sensor 58 to determine the tip angle $\beta$ of work tool 16 at periodic intervals as work tool 16 tilts towards ground surface 28. When controller 44 determines that tip angle $\beta$ of work tool 16 exceeds the target tip angle $\beta_{target}$ (Step 516: Yes), controller 44 may proceed to step 520. When controller 44 determines, however, that tip angle $\beta$ of work tool 16 is less than the target tip angle $\beta_{target}$ (Step 516: No), controller 44 may proceed to step 518 of determining whether first unrack has timed out.

Controller 44 may initialize a timer (i.e. set the timer to 0) when executing step 514 of unracking work tool 16. Controller 44 may monitor an elapsed time as tilt actuators 20 tilt work tool 16 toward ground surface 28. Controller may periodically compare the elapsed time with a target unrack time, which may represent a maximum amount of time permitted for unracking work tool 16. Controller 44 may determine that first unrack has timed out (Step 518), when the elapsed time exceeds the target first unrack time and tip angle $\beta$ of work tool 16 remains higher than the target tip angle $\beta_{target}$. When controller 44 determines that first unrack has timed out (Step 518: Yes), controller 44 may proceed to step 520. When controller 44 determines, however, that first unrack has not timed out (Step 518: No), controller 44 may return to step 514 to continue unracking work tool 16. Controller 44 may cycle through one or more of steps 514-518 to unrack work tool 16.

Method 500 may include a step of performing a second rack of work tool 16 (Step 520). Controller 44 may perform processes similar to those described above for step 508 to perform the second rack of work tool 16. Method 500 may include a step of determining whether a tilt velocity $V_{tilt}$ is less than a threshold velocity of work tool 16 (Step 522). Controller 44 may perform processes similar to those described above for step 510 to determine whether a tilt velocity $V_{tilt}$ is less than a threshold velocity of work tool 16. When controller 44 determines that tilt velocity $V_{tilt}$ of work tool 16 is less than the threshold velocity (Step 522: Yes), controller 44 may end method 500. When controller 44 determines, however, that tilt velocity $V_{tilt}$ of work tool 16 is greater than the threshold velocity (Step 522: No), controller 44 may proceed to step 524 of determining whether second rack has timed out.

Controller 44 may perform processes similar to those described above for step 512 to determine whether second rack has timed out. When controller 44 determines that second rack has timed out (Step 524: Yes), controller 44 may proceed to step 526. When controller 44 determines, however, that second rack has not timed out (Step 526: No), controller 44 may return to step 520 to continue racking work tool 16. Controller 44 may cycle through one or more of steps 520-524 to rack work tool 16.

Method 500 may include a step of performing a second unrack of work tool (526), determining whether the tip angle β exceeds $\beta_{target}$ (Step 528), and determining whether the second rack has timed out (Step 530). Controller 44 may perform processes similar to those described above for steps 514, 516, and 518 when performing steps 526, 528, and 530, respectively. In step 528, when controller 44 determines that tip angle β of work tool 16 exceeds the target tip angle $\beta_{target}$ (Step 528: Yes), controller 44 may proceed to step 532. When controller 44 determines, however, that tip angle β of work tool 16 is less than the target tip angle $\beta_{target}$ (Step 528: No), controller 44 may proceed to step 530 of determining whether second unrack has timed out. In step 530, when controller 44 determines that second unrack has timed out (Step 530: Yes), controller 44 may proceed to step 532. When controller 44 determines, however, that second unrack has not timed out (Step 530: No), controller 44 may return to step 526 to continue unracking work tool 16. Controller 44 may cycle through one or more of steps 526-528 to unrack work tool 16.

Method 500 may include a step of performing a third rack of work tool 16 (Step 532). Controller 44 may perform processes similar to those described above for steps 508 or 520 to perform the third rack of work tool 16. Method 500 may also include a step of determining whether the third rack has timed out (Step 534). Controller 44 may perform processes similar to those described above for steps 512 or 524 to determine whether third rack has timed out. When controller 44 determines that third rack has timed out (Step 534: Yes), controller 44 may end method 500. When controller 44 determines, however, that third rack has not timed out (Step 526: No), controller 44 may return to step 532 to continue racking work tool 16. Controller 44 may cycle through one or more of steps 532-534 to rack work tool 16.

As illustrated in FIG. 5 and described above, controller 44 may perform a first rack of work tool 16 (Step 508), followed by a first unrack of work tool 16 (Step 514), and a second rack of work tool 16 (Step 520) to shake work tool 16 to allow loose material to spill from work tool 16 onto material pile 34. While performing second rack of work tool 16 (Step 520), if controller 44 determines that the tilt velocity Vtilt of work tool 16 is higher than the threshold velocity and if the third rack times out (i.e. the third rack cannot be completed in the allocated time), then controller 44 proceeds to perform a second unrack of work tool 16 (Step 526), followed by a third rack of work tool 16 (Step 534). The additional second unrack (Step 526) and third rack (Step 534) may allow controller 44 to help ensure work tool 16 is not stalled or stuck and can move freely before allowing machine 10 to withdraw from material pile 34. By performing the process of repeatedly racking and unracking work tool 16 according to method 500, controller 44 may help ensure that loose material from work tool 16 can be dislodged at material pile 34, which may prevent debris from falling from work tool 16 onto the path travelled on by machine 10.

It will be apparent to those skilled in the art that various modifications and variations can be made to the disclosed excavation system. Other embodiments will be apparent to those skilled in the art from consideration of the specification and practice of the disclosed excavation system. It is intended that the specification and examples be considered as exemplary only, with a true scope being indicated by the following claims and their equivalents.

What is claimed is:

1. An excavation system for a machine having a work tool, comprising:

at least one sensor configured to generate a signal indicative of a load exerted on the work tool;

a lift actuator configured to lift the work tool above a ground surface;

a tilt actuator configured to tilt the work tool; and a controller in communication with the sensor, the lift actuator, and the tilt actuator, the controller being configured to:

detect engagement of the work tool with a material pile based on the signal;

operate the work tool to load the work tool with an amount of material;

determine whether loading of the work tool has been completed;

operate the lift actuator to lift the work tool when the loading has been completed;

operate the tilt actuator to shake the work tool based on a tilt velocity of the work tool with respect to a threshold velocity; and cause the machine to withdraw from the material pile after shaking the work tool.

2. The excavation system of claim 1, wherein the controller is configured to determine that loading of the work tool has been completed when at least one of a height of a pivot pin of the work tool exceeds a target height, the amount of material in the work tool exceeds a threshold amount, a penetration distance exceeds a target penetration distance, a tip angle of the work tool is equal to a target tip angle, and a tip of the work tool is not in contact with the material pile.

3. The excavation system of claim 1, wherein the controller is configured to shake the work tool by:

performing a first rack of the work tool;

monitoring the tilt velocity of the work tool; and performing a first unrack of the work tool, when the tilt velocity is less than the threshold velocity.

4. The excavation system of claim 3, wherein the controller is further configured to shake the work tool by:

monitoring a tip angle of the work tool while performing the first unrack of the work tool;

performing a second rack of the work tool, when the tip angle is equal to a target tip angle;

monitoring the tilt velocity during the second rack of the work tool; and stopping the second rack of the work tool when the tilt velocity is less than the threshold velocity.

5. The excavation system of claim 4, wherein the threshold velocity is 0.03 m/s.

6. The excavation system of claim 4, wherein the target tip angle ranges between 3° to 5°.

7. The excavation system of claim 1, wherein the controller is configured to shake the work tool by:

performing a first rack of the work tool;

monitoring a tilt velocity; and performing a first unrack of the work tool, when the tilt velocity is greater than a threshold velocity and the first rack has timed out.

8. The excavation system of claim 7, wherein the controller is further configured to shake the work tool by:

monitoring a tip angle of the work tool while performing the first unrack of the work tool;

performing a second rack of the work tool, when the tip angle is greater than a target tip angle and the first unrack has timed out;

monitoring the tilt velocity during the second rack of the work tool; and stopping the second rack of the work tool when the tilt velocity is less than the threshold velocity.

9. The excavation system of claim 1, wherein the controller is further configured to:

monitor a length of extension of the lift actuator; and stop lifting the work tool when the length of extension reaches a target length.

10. The excavation system of claim 9, wherein the target length ranges from 15% to 20% of a maximum length of extension of the lift actuator.

11. A method of controlling a machine having a work tool, comprising:

sensing a parameter indicative of a load exerted on the work tool;

detecting engagement of the work tool with a material pile based on the parameter;

operating the work tool to load the work tool with an amount of material;

determining whether loading of the work tool has been completed;

lifting the work tool above a ground surface, using a lift actuator of the machine, when the loading has been completed;

shaking the work tool based on a tilt velocity of the work tool with respect to a threshold velocity, using a tilt actuator of the machine; and causing the machine to withdraw from the material pile after shaking the work tool.

12. The method of claim 11, determining whether loading of the work tool has been completed includes determining whether at least one of:

a height of a pivot pin of the work tool exceeds a target height;

the amount of material in the work tool exceeds a threshold amount;

a penetration distance exceeds a target penetration distance;

a tip angle of the work tool is equal to a target tip angle; and a tip of the work tool is not in contact with the material pile.

13. The method of claim 11, wherein shaking the work tool includes:

performing a first rack of the work tool;

monitoring a tilt velocity; and performing a first unrack of the work tool, when the tilt velocity is less than a threshold velocity.

14. The method of claim 13, wherein shaking the work tool further includes:

monitoring a tip angle of the work tool while performing the first unrack of the work tool;

performing a second rack of the work tool, when the tip angle is equal to a target tip angle;

monitoring the tilt velocity while performing the second rack of the work tool; and stopping the second rack of the work tool when the tilt velocity is less than the threshold velocity.

15. The method of claim 11, wherein shaking the work tool further includes:

performing a first rack of the work tool;

monitoring a tilt velocity; and performing a first unrack of the work tool, when the tilt velocity is greater than a threshold velocity and the first rack has timed out.

16. The method of claim 15, wherein shaking the work tool further includes:

monitoring a tip angle of the work tool while performing the first unrack of the work tool;

performing a second rack of the work tool, when the tip angle is greater than a target tip angle and the first unrack has timed out;

monitoring the tilt velocity while performing the second rack of the work tool; and stopping the second rack of the work tool when the tilt velocity is less than the threshold velocity.

17. The method of claim 16, wherein shaking the work tool further includes:

performing a second unrack of the work tool when the tilt velocity exceeds the threshold velocity and the second rack has timed out;

performing a third rack of the work tool, when the tip angle is less than the target tip angle and the second unrack has timed out; and frame;

stopping the third rack of the work tool when the third rack has timed out.

18. The method of claim 11, wherein lifting the work tool further includes:

monitoring a length of extension of the lift actuator; and stopping lifting the work tool when the length of extension reaches a target length.

19. A machine, comprising:

a frame;

a plurality of wheels rotatably connected to the frame and configured to support the frame a power source mounted to the frame and configured to drive the plurality of wheels;

a work tool operatively connected to the frame, driven by the power source, and having a tip configured to engage a material pile;

a lift actuator configured to lift the work tool above a ground surface;

a tilt actuator configured to tilt the work tool;

a speed sensor associated with the plurality of wheels and configured to generate a first signal indicative of a travel speed of the machine;

a torque sensor associated with the power source and configured to generate a second signal indicative of a torque output of the power source;

an acceleration sensor configured to generate a third signal indicative of an acceleration of the machine; and a controller in communication with the speed sensor, the torque sensor, and the acceleration sensor, the controller being configured to:

detect engagement of the work tool with the material pile based on at least one of the first, second, and third signals;

operate the work tool to load the work tool with an amount of material;

determine whether loading of the work tool has been completed;

lift the work tool, using the lift actuator, when the loading has been completed;

monitor a length of extension of the lift actuator, wherein a target length ranges from 15% to 20% of a maximum length of extension of the lift actuator;

stop lifting the work tool when the length of extension reaches the target length;

perform a first rack of the work tool;

monitor a tilt velocity; and perform a first unrack of the work tool, when the tilt velocity is less than a threshold velocity;

monitor a tip angle of the work tool while performing the first unrack of the work tool; and perform a second rack of the work tool when the tip angle is equal to a target tip angle.

20. The machine of claim 19, wherein the controller is further configured to:

monitor the tilt velocity while performing the second rack; and perform a second unrack of the work tool, when the tilt velocity exceeds the threshold velocity and the second rack has timed out.

* * * * *